US008000619B2

(12) United States Patent
Chae et al.

(10) Patent No.: US 8,000,619 B2
(45) Date of Patent: Aug. 16, 2011

(54) FIXING DEVICE USABLE WITH AN IMAGE FORMING APPARATUS

(75) Inventors: Young-min Chae, Suwon-si (KR); Jin-ha Kim, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/549,612

(22) Filed: Aug. 28, 2009

(65) Prior Publication Data

US 2009/0317111 A1 Dec. 24, 2009

Related U.S. Application Data

(62) Division of application No. 11/345,399, filed on Feb. 2, 2006, now Pat. No. 7,742,711.

(30) Foreign Application Priority Data

Mar. 17, 2005 (KR) ..... 2005-22342

(51) Int. Cl.
*G03G 15/20* (2006.01)
*G03G 15/00* (2006.01)

(52) U.S. Cl. ..... 399/33; 399/37

(58) Field of Classification Search ..... 399/33, 399/37

See application file for complete search history.

(56) References Cited

U.S. PATENT DOCUMENTS

| | | | |
|---|---|---|---|
| 4,740,671 | A | 4/1988 | Kuroda et al. |
| 5,822,669 | A | 10/1998 | Okabayashi et al. |

FOREIGN PATENT DOCUMENTS

| | | | |
|---|---|---|---|
| JP | 03-15884 | | 1/1991 |
| JP | 10-307514 | | 11/1998 |
| JP | 2004206979 | A * | 7/2004 |
| JP | 2004-226492 | | 8/2004 |
| KR | 10-0214572 | | 4/1993 |
| KR | 10-0263042 | | 5/1994 |
| KR | 0134509 | | 12/1997 |

OTHER PUBLICATIONS

Chinese Letters Patent Issued Jul. 1, 2009 in CN Patent No. 200610051409.1.

* cited by examiner

*Primary Examiner* — David Gray
*Assistant Examiner* — Erika J Villaluna
(74) *Attorney, Agent, or Firm* — Stanzione & Kim, LLP

(57) ABSTRACT

A fixing device usable with an image forming apparatus having a fixing roller to fix a toner on a recording medium, a heater to heat the fixing roller, and an alternating current (AC) power source to supply an AC electric power to the heater may include a power converting part to convert the AC electric power of the AC power source and to supply the converted power to the heater; a relay including a first relay contact point disposed on a first AC power supply line between the AC power source and the power converting part and a relay coil to open and close the first relay contact point, the relay selectively supplying the AC electric power from the AC power source to the heater and the power converting part; a direct current (DC) power supplier to supply a DC power to the relay coil; and a thermoswitch interposed between the relay coil and the DC power supplier and mounted adjacent to the fixing roller so as to interrupt the DC power from the DC power supplier to the relay coil, when a temperature of the fixing roller exceeds a threshold temperature, causing the relay coil to open the first relay contact point.

14 Claims, 6 Drawing Sheets

FIXING DEVICE USABLE WITH AN IMAGE FORMING APPARATUS

CROSS-REFERENCE TO RELATED APPLICATIONS

This application is a divisional of prior application Ser. No. 11/345,399, filed on Feb. 2, 2006 now U.S. Pat. No. 7,742,711 in the U.S. Patent and Trademark Office, the disclosure of which is incorporated herein by reference in its entirety. This application claims the benefit of Korean Patent Application No. 2005-22342, filed on Mar. 17, 2005 in the Korean Intellectual Property Office, the disclosure of which is incorporated herein by reference in its entirety.

BACKGROUND OF THE INVENTION

1. Field of the Invention

The present general inventive concept relates to a fixing device usable with an image forming apparatus, and more particularly, to a fixing device usable with an image forming apparatus in which a manufacturing cost is reduced and credibility and stability on an overheating prevention operation are improved.

2. Description of the Related Art

An image forming apparatus, such as a laser printer and the like, has a charging process which rotates an electric charging roller adjacent to an opto photo-organic conductor (OPC) drum and charges a surface of the OPC drum, an exposure process which scans a laser beam from a laser scanning unit (LSU) to the surface of the OPC drum and forms a desired electrostatic latent image on the surface of the OPC drum, a developing process which supplies a toner to the surface of the OPC drum and develops the electrostatic latent image formed on the surface of the OPC drum into a toner image of a powder state which is an visible image, a transferring process which applies a predetermined transfer voltage to a transferring roller contacting the OPC drum with a predetermined pressure and the OPC drum formed with the toner image and transfers the toner image formed on the OPC drum to a recording medium passing between the transferring roller and the OPC drum, and a fixing process which heats the recording medium with the toner image and melts the toner image of the powder state to fuse the toner image on the recording medium employing a fixing device having a fixing roller. Therefore, the image forming apparatus forms the desired image on the recording medium according to the above processes.

In the fixing process, a heater is mounted inside the fixing roller and/or a fixing back up roller, as a heat source for fixing. Radiant heat from the heater heats a surface of the fixing roller in a predetermined temperature range.

FIG. 1 illustrates schematically a conventional fixing device 200 for an image forming apparatus. As shown in FIG. 1, the fixing device 200 includes a fixing roller 204 having a cylinder shape and formed with a layer coated with Teflon, etc., and a heater 206 mounted at a center of an inside of the fixing roller 204. The heater 206 generates heat inside the fixing roller 204, and radiant heat generated from the heater 206 heats the fixing roller 203.

In a lower part of the fixing roller 204 is mounted a fixing back up roller (not shown). The fixing back up roller is elastically supported by a predetermined elastic member and pressurizes a recoding medium passing between the fixing roller 204 and the fixing back up roller with a predetermined pressure for fixing the toner image on the recording medium.

The toner image of a powder state formed on the recording medium passes between the fixing roller 204 and the fixing back up roller to be pressurized and heated by the predetermined pressure and heat. Accordingly, the toner image is fused to the recording medium.

Near the fixing roller 204 is mounted a thermistor 208 which detects a surface temperature of the fixing roller 204 and outputs an electric signal as an output signal according to the detected surface temperature. The fixing device 200 comprises a power control switch 212 supplying and interrupting an electric power from a power supplier 202 to the heater 206 corresponding to a signal from a switch controller 210 according to the output signal of the thermistor 208.

The switch controller 210 turns on/off the power control switch 212 according to a comparison between a temperature detected by the thermistor 208 and a predetermined set temperature, thereby controlling a power supply to the heater 206. Therefore, the surface temperature of the fixing roller 204 is controlled enough to fix the toner image to the recording medium.

The fixing device 200 comprises a thermoswitch 214, such as a thermostat, that interrupts the electric power supplied to the heater 206, in case where the surface temperature of the fixing roller 204 reaches a predetermined overheating temperature. The thermoswitch 214 operates as overheating prevention means for protecting elements adjacent to the fixing roller 204 when the fixing roller 204 is overheated in a case where the thermistor 208, the switch controller 210, and the power control switch 212 can not control the surface temperature of the fixing roller 204.

Because the thermoswitch 214 of the conventional fixing device 200 is connected in series between the power supplier 202 and heater 206, the conventional thermoswitch 214 should have an electric power capacity corresponding to the electric power supplied to the heater 206. Particularly, in a case of the heater 206 calling for the high frequency power such an induction heating method, the supplied electric power increases and the electric power capacity of the thermoswitch 214 corresponding thereto also increases, thereby increasing manufacturing costs.

Therefore, there is needed a device to reduce the manufacturing costs of the fixing device and ensure credibility and stability on an overheating prevention operation.

SUMMARY OF THE INVENTION

The present invention provides a fixing device usable with an image forming apparatus in which manufacturing costs are reduced and credibility and stability on an overheating prevention operation are improved.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing a fixing device usable with an image forming apparatus having a fixing roller to fix a toner on a recording medium, a heater to heat the fixing roller, and an alternating current (AC) power source to supply an AC electric power to the heater, the fixing device including a power converting part to convert the AC electric power of the AC power source and to supply the converted power to the heater; a relay comprising a first relay contact point disposed on a first AC power supply line between the AC power source and the power converting part and a relay coil to open and close the first relay contact point, the relay selectively supplying the AC electric power from the AC power source to the heater and the power converting part;

a direct current (DC) power supplier to supply a DC power to the relay coil; and a thermoswitch interposed between the relay coil and the DC power supplier and mounted adjacent to the fixing roller so as to interrupt the DC power from the DC power supplier to the relay coil, when a temperature of the fixing roller exceeds a threshold temperature, causing the relay coil to open the first relay contact point.

The DC power supplier may supply the DC power to the power converting part. The thermoswitch may be disposed at a common DC power supply line from the DC power supplier to the relay coil and the power converting part to interrupt the DC power from the DC power supplier to both the relay coil and the power converting part when the temperature of the fixing roller exceeds the threshold temperature.

The power converting part may convert the AC electric power of the AC power source into a high frequency power as the converted power and supplies the high frequency power to the heater. The relay may further includes a second relay contact point which is driven by the relay coil and disposed on a second AC power supply line between the heater and the AC power source. The thermoswitch may include two thermoswitches which are mounted at different positions adjacent to the fixing roller, respectively. The two thermoswitches may be connected in series. The thermoswitch may include three or more thermoswitches which are mounted at different positions adjacent to the fixing roller, respectively.

The DC power supplier may supply the DC power to the power converting part. The thermoswitch may include a first thermoswitch to be interposed between the relay coil and the DC power supplier and interrupt the DC power from the DC power supplier to the relay coil when a temperature of the fixing roller exceeds a first threshold temperature, and a second thermoswitch to be interposed between the power converting part and the DC power supplier and interrupt the DC power from the DC power supplier to the power converting part when a temperature of the fixing roller exceeds a second threshold temperature. The DC power supplier may include a first DC power supplier to supply a first DC power to the relay coil, and a second DC power supplier to supply a second DC power to the power converting part. The relay may further include a second relay contact point which is driven by the relay coil and disposed on a second AC power supply line between the heater and the AC power source. At least one of the first thermoswitch and the second thermoswitch may include two thermoswitches which are mounted at different positions adjacent to the fixing roller, respectively. The two thermoswitches may be connected in series. At least one of the first thermoswitch and the second thermoswitch may include three or more thermoswitches which are mounted at different positions adjacent to the fixing roller, respectively.

The foregoing and/or other aspects of the present general inventive concept may also be achieved by providing an image forming apparatus, including a fixing roller to fix a toner on a recording medium; a heater to heat the fixing roller; an alternating current (AC) power source to generate an AC electric power such that the heater heats the fixing roller according to the AC electric power; a unit interposed between the heater and the AC power source to selectively supply the AC electric power from the AC power source to the heater so as to control the heater to heat the fixing roller; a relay including a first relay contact point disposed on a first AC power supply line between the AC power source and the unit and a relay coil to open and close the first relay contact point, the relay selectively supplying the AC electric power from AC power source to the heater and the power control switch; a direct current (DC) power supplier to supply a DC power to the relay coil; and a thermoswitch interposed on a DC power supply line between the DC power supplier and the relay coil to control the supply of the AC electric power from the AC power source to the heater and the unit according to an overheating temperature of the fixing roller and the DC power of the DC power supplier. The unit may include a power converting part to convert the AC electric power to a frequency power, and the electric power has a first frequency, and the frequency power has a second frequency higher than the first frequency.

The DC power supplier may supply the DC power to the power converting part. The thermoswitch may be disposed at a common DC power supply line from the DC power supplier to the relay coil and the power converting part to interrupt the DC power from the DC power supplier to both the relay coil and the power converting part when the temperature of the fixing roller exceeds the threshold temperature. The thermoswitch may include a plurality of thermoswitches connected in parallel between the unit and the DC power supplier. The DC power supplier may include first and second power DC power suppliers to supply the DC power to the power converting part and the relay coil, respectively. The thermoswitch may include first and second thermoswitches connected between the first DC power supplier and the power converting part and between the second DC power supplier and the relay coil, respectively.

The relay may further include a second relay contact point which is driven by the relay coil and disposed on a second AC power supply line between the heater and the AC power source. The thermoswitch may include two thermoswitches which are mounted at different positions adjacent to the fixing roller, respectively. The two thermoswitches may be connected in series. The thermoswitch may include three or more thermoswitches which are mounted at different positions adjacent to the fixing roller, respectively.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
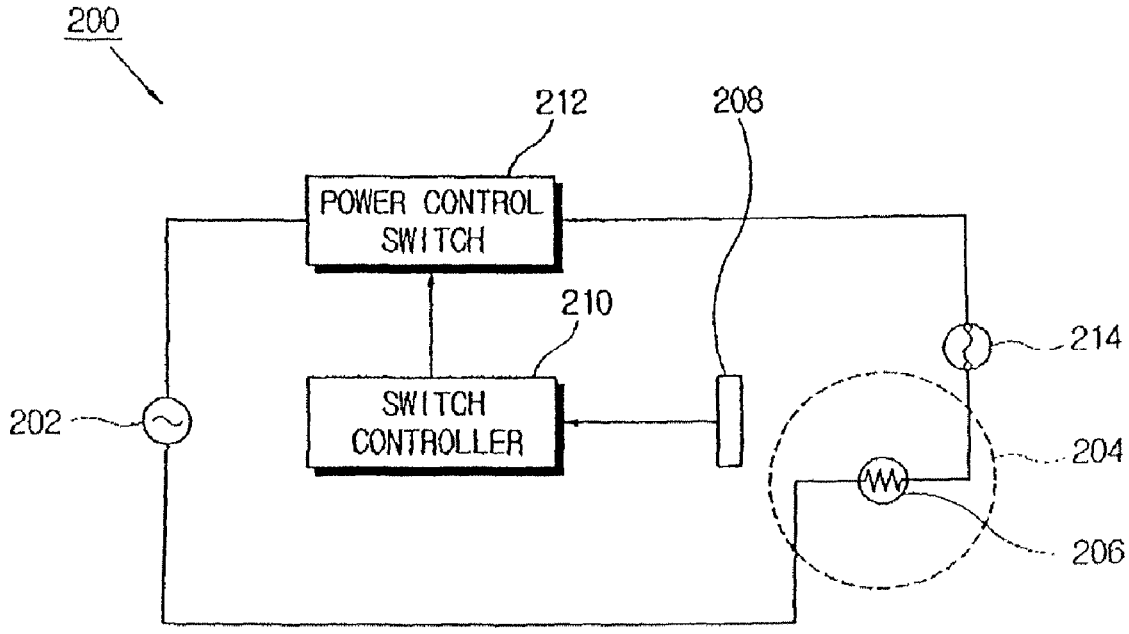
FIG. 1 (PRIOR ART)
FIG. 1 is a block diagram illustrating a circuit construction of a conventional fixing device for a conventional image forming apparatus.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

Figure 2:
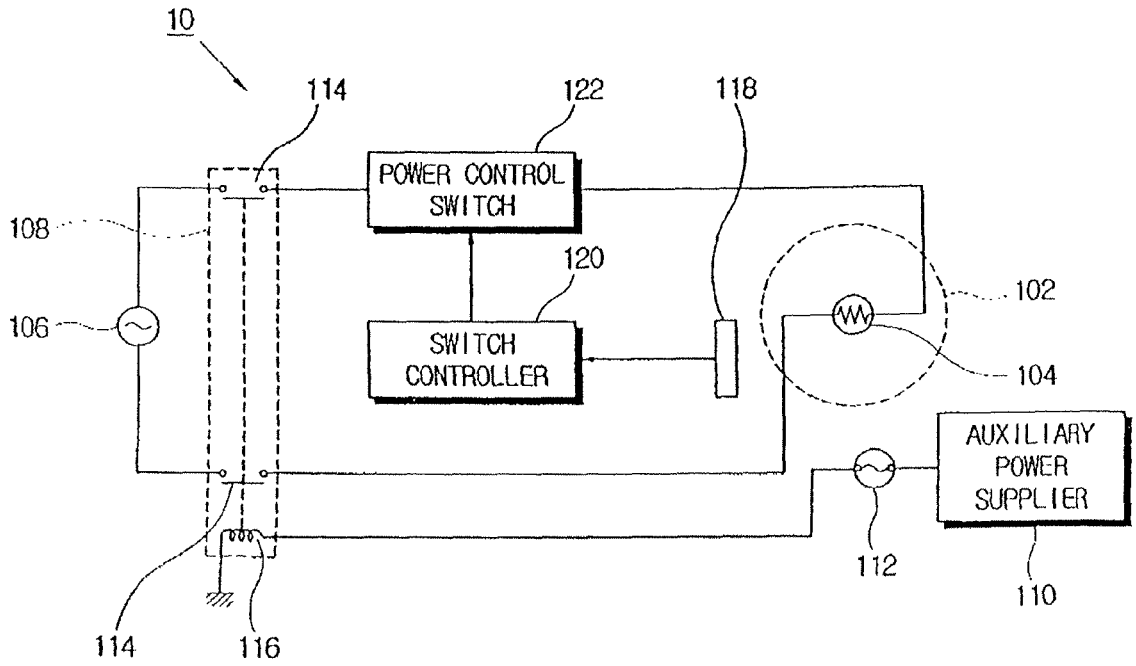
FIG. 2 is a block diagram illustrating a circuit construction of a fixing device usable with an image forming apparatus according to an embodiment of the present general inventive concept.

FIG. 2 is a block diagram illustrating a circuit construction of a fixing device 10 usable with an image forming apparatus according to an embodiment of the present general inventive concept. The fixing device 10 is mounted at the image forming apparatus, such as a laser printer and the like, and fixes a toner image on a recording medium. That is, the fixing device 10 forms a desired image on the recording medium by a fixing process which heats the recording medium with the toner image and melts the toner image of a powder state to fuse it on the recording medium.

As illustrated in FIG. 2, the fixing device 10 comprises a fixing roller 102 to fix the toner image on the recording medium, a heater 104 to heat the fixing roller 102, and a power supplier 106 to supply an electric power to the heater 104.

The heater 104 is mounted inside the fixing roller 102, as a heat source, to fix the toner image. A surface of the fixing roller 102 is heated by radiant heat radiated from the heater 104. The heater 104 may include a halogen lamp and the like.

The fixing device 10 further comprises a relay 108, an auxiliary power supplier 110 and a thermoswitch 112. The relay 108 is interposed between the power supplier 106 and the heater 104, and supplies and interrupts the electric power to the heater 104 as a heating signal to heat the heater 104. The relay 108 comprises relay contact points 114 mounted both ends of the power supplier 106, and a relay coil 116 to operate the relay contact points 114.

The relay 108 receives a driving power from the auxiliary power supplier 110 through the thermoswitch 112. If the driving power is supplied to the relay coil 116 through the thermoswitch 112, the relay contact points 114 are closed by a current flowing in the relay coil 116, and if the driving power is interrupted by the thermoswitch 112 because of an overheating temperature of the fixing roller 102, the relay contact points 114 are opened.

The thermoswitch 112 is interposed between the relay 108 and the auxiliary power supplier 110 to be operated by the heat, for example, the overheating temperature of the fixing roller 102. Therefore, in a case of a predetermined temperature or higher, the thermoswitch 112 is electrically opened, thereby interrupting the driving power supplied to the relay 108. Here, the thermoswitch 112 is mounted adjacent to the surface of the fixing roller 104 and electrically opened when the surface temperature of the fixing roller 104 reaches a predetermined overheating temperature. The thermoswitch 112 may be a thermostat and the like.

The power supplier 106 has the electric power with a frequency of 60 Hz, as a power source that makes the heater 104 generate the heat. However, the auxiliary power supplier 110 has the electric power capable of operating only the relay 108, so that the current flowing through the relay coil 116 of the relay 108 is relatively lower than the current supplied to the heater 104. Therefore, the power capacity of the thermoswitch 112 is relatively smaller than that of the conventional thermoswitch connected with the heater in series, so that the manufacturing costs of the fixing device 10 can be reduced.

Further, the thermoswitch 112 may not be a logic circuit but a physical switching operation (mechanical switch) to interrupt the driving power of the relay 108, thereby enhancing the credibility and the stability on the overheating prevention operation.

The fixing device 10 further comprises a thermistor 118 mounted adjacent to the fixing roller 102 to detect the surface temperature of the fixing roller 102 and to output an electric signal corresponding to a temperature detected by the thermistor 118, a power control switch 122 to supply and interrupt the electric power from the power supplier 106 to the heater 104, and a switch controller 120 to turn on/off the power control switch 122 according to a comparison between the temperature detected by the thermistor 118 and a predetermined set temperature, so that the surface temperature of the fixing roller 102 is controlled enough to fix the image to the recording medium.

Figure 3:
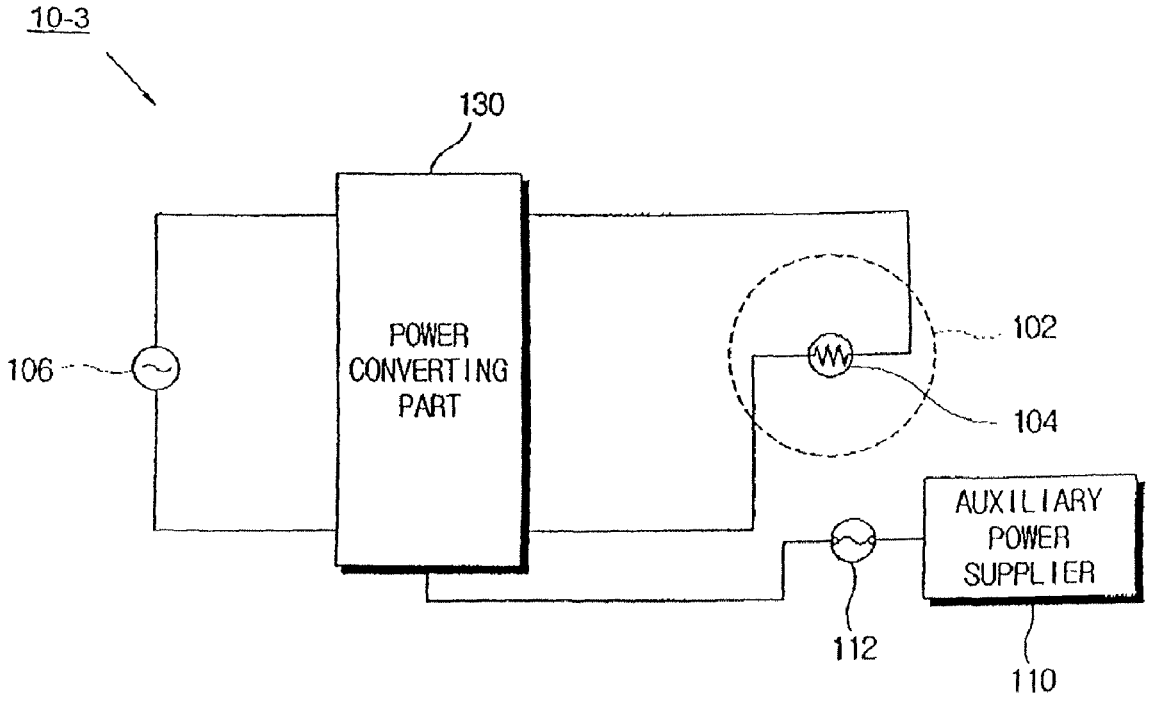
FIG. 3 is a block diagram illustrating a fixing device usable with an image forming apparatus according to another embodiment of the present general inventive concept.

FIG. 3 is a block diagram illustrating a fixing device 10-3 usable with an image forming apparatus according to another embodiment of the present general inventive concept. As illustrated in FIG. 3, the fixing device 10-3 comprises a fixing roller 102, a heater 104, a power supplier 106, a power converting part 130 to convert an electric power from the power supplier 106 into a second electric power as a heating signal to heat the heater 104 and to supply the converted power to the heater 104, an auxiliary power supplier 110 to supply a driving power to the power converting part 130, and a thermoswitch 112 interposed between the power converting part 130 and the auxiliary power supplier 110 to be electrically opened in a case where the fixing roller 102 reaches a predetermined overheating temperature.

The power converting part 130 converts the electric power of the power supplier 106 with the frequency of 60 Hz into the second electric power having a frequency range of from several tens KHz to several hundreds KHz, and supplies the high frequency power required from an induction heating (IH), as a high frequency power convert device. Here, the power converting part 130 may use a logic circuit such as transistor transistor logic (TTL) and the like. The auxiliary power supplier 110 supplies a direct current (DC) power of several volts, which is needed for the logic circuit.

The thermoswitch 112 is electrically opened when the surface temperature of the fixing roller 102 reaches the predetermined overheating temperature, thereby interrupting the electric power supplied to the power converting part 130. Accordingly, an operation of the power converting part 130 is stopped, so that the electric power supplied to the heater 104 is interrupted, and the second electric power is not generated from the power converting part 130.

Therefore, according to this embodiment of the prevent general inventive concept, even in a case where a higher electric power having a high frequency is required, the thermoswitch 112 is mounted to the auxiliary power supplier 110 which has a relatively lower power level than that of the power supplier 106, to thereby reduce the manufacturing costs of the fixing device 10-3.

Figure 4:
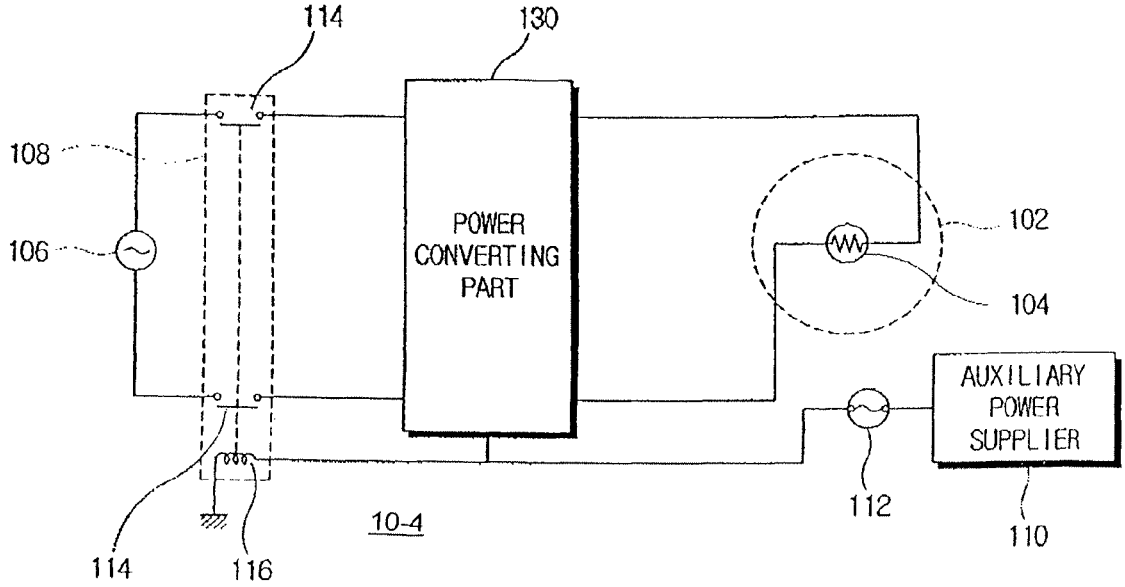
FIG. 4 is a block diagram illustrating a fixing device usable with an image forming apparatus according to another embodiment of the present general inventive concept.

FIG. 4 is a block diagram illustrating a fixing device 10-4 usable with an image forming apparatus according to another embodiment of the present general inventive concept. As illustrated in FIG. 4, the fixing device 10-4 comprises a fixing roller 102, a heater 104, a power supplier 106, a relay 108 to supply and interrupt an electric power from the power supplier 106 to the heater 104, a power converting part 130 to convert the electric power from the power supplier 130 and to supply the converted power to the heater 104, an auxiliary power supplier 110 to supply a driving power to the relay 108 and the power converting part 130, and a thermoswitch 112 interposed between the relay 108 and the auxiliary power supplier 110 to be electrically opened in a case where the fixing roller 102 reaches a predetermined overheating temperature. That is, because the relay 108 and the power converting part 130 are connected with the thermoswitch 112 in parallel, if the thermoswitch 112 is opened, all of the driving powers are interrupted. Therefore, the electric power of the power supplier 106 is not supplied to the heater 104.

Accordingly, this embodiment of the present general inventive concept also reduces the manufacturing cost since the power capacity of the thermoswitch 112 is reduced, and the credibility and stability on the overheating prevention operation are enhanced. Besides, even if the power converting part 130 is mounted, the fixing device 10 prevents the power converting part 130 from consuming wasteful power caused due to overheat of the fixing roller 102.

Figure 5:
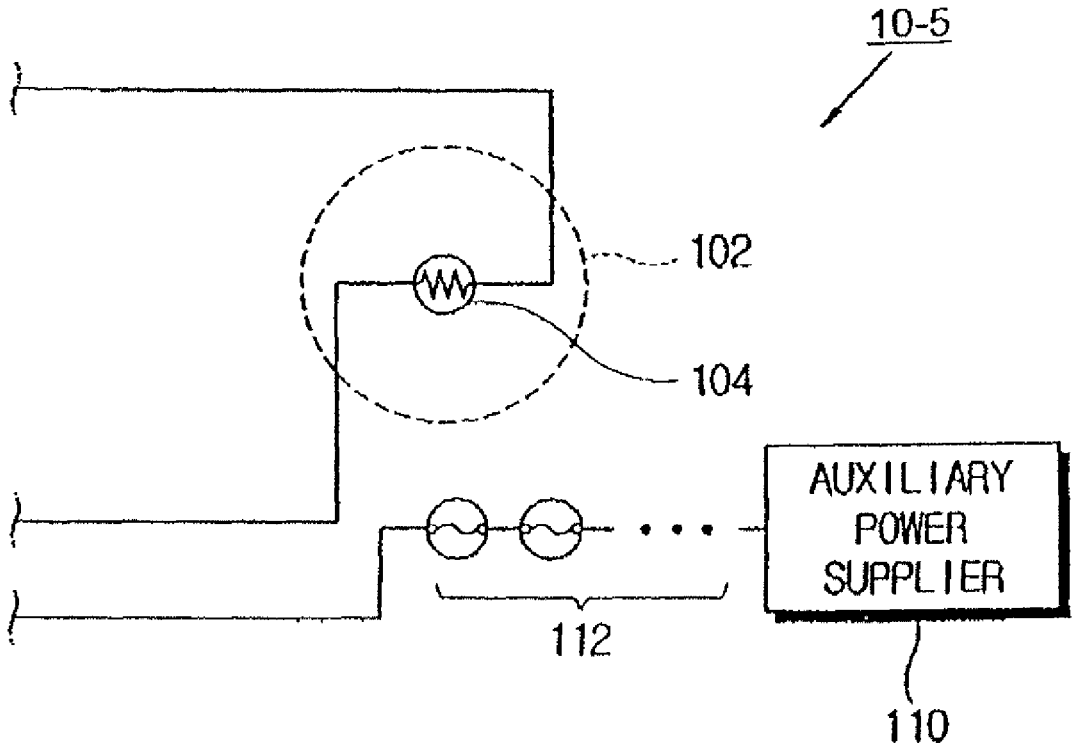
FIG. 5 is a block diagram illustrating a fixing device usable with an image forming apparatus according to another embodiment of the present general inventive concept.

FIG. 5 is a block diagram illustrating a fixing device 10-5 usable with an image forming apparatus according to another embodiment of the present general inventive concept. As illustrated in FIG. 5, in the fixing device 10, a plurality of thermoswitches 112 are connected with each other in series. The plurality of thermoswitches 112 may have the same or similar characteristics. That is, in a case where the surface temperature of the fixing roller 102 reaches the predetermined overheating temperature, at least one of the plurality of thermoswitches 112 is opened, thereby enhancing the credibility and stability on the overheating prevention operation. The plurality of thermoswitches 112 may have different characteristics. That is, when the surface temperature of the fixing roller 102 reaches one of overheating temperatures, a corresponding one of the plurality of thermoswitches 112 is opened, thereby enhancing the credibility and stability on the overheating prevention operation.

Figure 6:
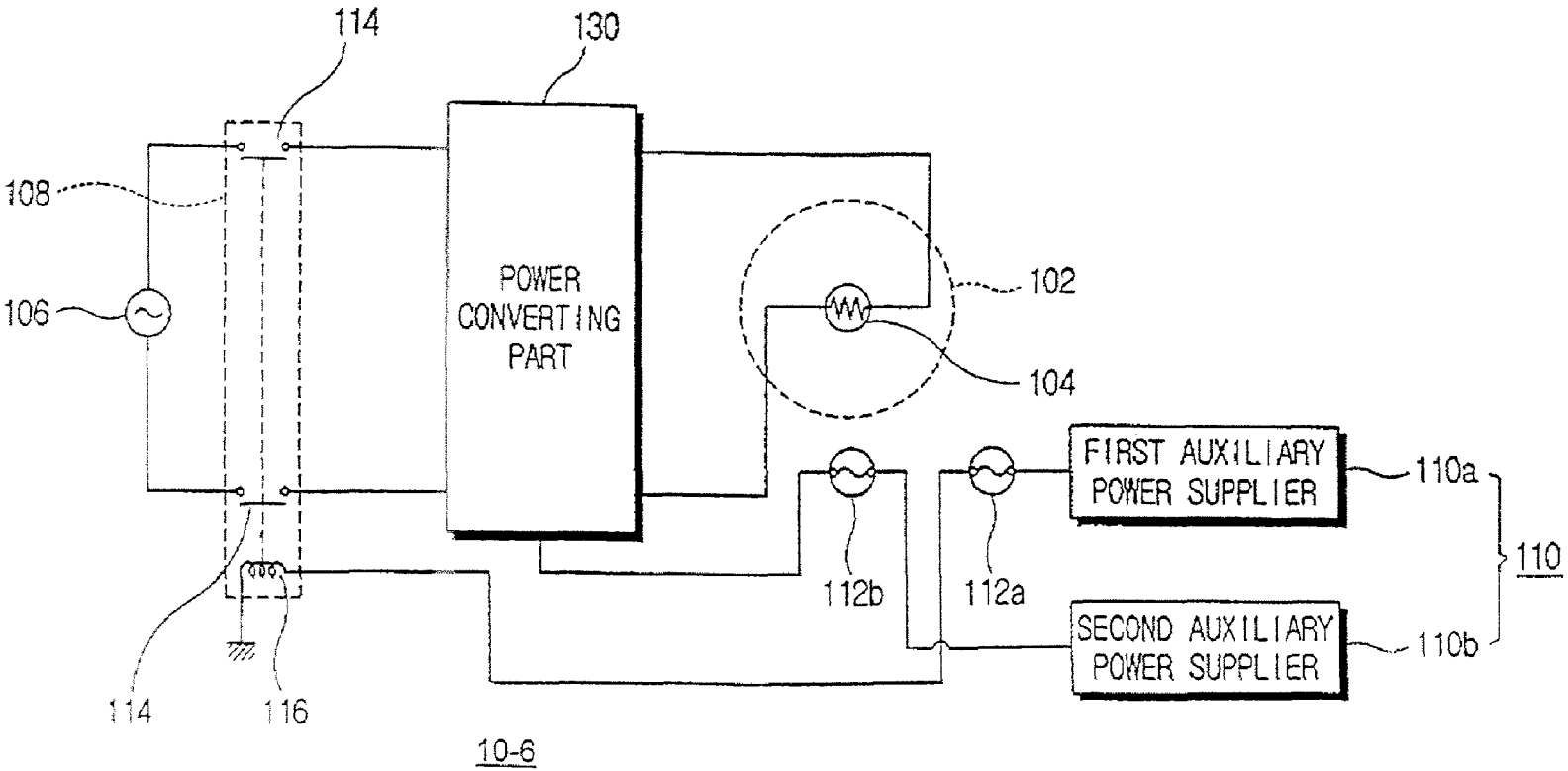
FIG. 6 is a block diagram illustrating a fixing device usable with an image forming apparatus according to another embodiment of the present general inventive concept.

FIG. 6 is a block diagram illustrating a fixing device 10-6 usable with an image forming apparatus according to another embodiment of the present general inventive concept. As illustrated in FIG. 6, the fixing device 10 comprises a fixing roller 102, a heater 104, a power supplier 106, a relay 108 to supply and interrupt an electric power from the power supplier 106 to the heater 104, a power converting part 130 to convert the electric power from the power supplier 106 and to supply the converted power to the heater 104, first and second auxiliary power suppliers 110*a* and 110*b* to supply a driving power to the relay 108 and the power converting part 130, respectively, and first and second thermoswitches 112*a* and 112*b* interposed respectively between the relay 108 and the first auxiliary power supplier 110*a* and between the power converting part 130 and the second auxiliary power supplier 110*b* and mounted adjacent to the fixing roller 10 to be electrically opened in a case where the fixing roller 10 reaches the predetermined overheating temperature.

The first and second auxiliary parts 110*a* and 110*b* supply the electric power of a proper level to the relay 108 and the power converting part 130, respectively, and the first and second thermoswitches 112*a* and 112*b* have a power capacity corresponding to each current flowing through the relay 10 and the power converting part 130.

Therefore, even in a case where the relay 108 and the power converting part 130 may require the electric power supply of each different level, the thermoswitches 112*a* and 112*b* corresponding thereto are mounted, thereby reducing the manufacturing costs of the fixing unit 10 and enhancing the credibility and the stability on the overheating prevention operation.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A fixing device usable with an image forming apparatus having a fixing roller to fix a toner on a recording medium, a heater to heat the fixing roller, and an alternating current (AC) power source to supply an AC electric power to the heater, the fixing device comprising:

a power converting part to convert the AC electric power with a low frequency from the AC power source to a high frequency power suitable for induction heating of the heater and to apply the converted high frequency power to the heater;

a relay comprising:

a first relay contact point disposed on a first AC power supply line between the AC power source and the power converting part; and a relay coil to open and close the first relay contact point, the relay selectively supplying the AC electric power from the AC power source to the power converting part;

a direct current (DC) power supplier to supply a DC power to the relay coil; and a DC thermoswitch interposed between the relay coil and the DC power supplier and mounted adjacent to the fixing roller so as to interrupt the DC power from the DC power supplier to the relay coil, when a temperature of the fixing roller exceeds a threshold temperature, causing the relay coil to open the first relay contact point, wherein the first relay contact point is situated with respect to the AC power source and the power converting part such that, when the first relay contact point is in an open position, the AC electric power from the AC power source is prevented from being supplied to the power converting part, thereby no high frequency power is applied to the heater, and wherein the DC thermoswitch comprises a plurality of DC thermoswitches connected in series such that, when at least one of the plurality of DC thermoswitches is switched to an open position according to overheating of the fixing roller, the DC power from the DC power supplier is prevented from being supplied to the relay coil to stop an operation of the power converting part and not to output the converted high frequency power to the heater.

2. The fixing device according to claim 1, wherein:

the DC power supplier supplies the DC power to a logic circuit of the power converting part, and the plurality of DC thermoswitches are situated with respect to the DC power supplier, the relay coil and the power converting part such that, when at least one of the DC thermoswitches is switched to an open position according to overheating of the fixing roller, the DC power from the DC power supplier is prevented from being supplied to both the relay coil and the logic circuit of power converting part to stop an operation of the power converting part and not to output the converted high frequency power to the heater.

3. The fixing device according to claim 1, wherein:

the relay further comprises a second relay contact point which is driven by the relay coil and disposed on a second AC power supply line between the heater and the AC power source.

4. The fixing device according to claim 1, wherein:

the plurality of DC thermoswitches comprises two DC thermoswitches which are mounted at different positions adjacent to the fixing roller, respectively, and the two DC thermoswitches are directly connected in series.

5. The fixing device according to claim 4, wherein:

the plurality of DC thermoswitches comprises:

a first DC thermoswitch to interrupt the DC power from the DC power supplier to the relay coil when a temperature of the fixing roller exceeds a first threshold temperature; and a second DC thermoswitch to interrupt the DC power from the DC power supplier to the relay coil when a temperature of the fixing roller exceeds a second threshold temperature different from the first threshold temperature.

6. The fixing device according to claim 1, wherein:

the plurality of DC thermoswitches comprises three or more DC thermoswitches which are mounted at different positions adjacent to the fixing roller, respectively.

7. The fixing device according to claim 1, wherein:

the DC power supplier supplies the DC power to a logic circuit of the power converting part, and the plurality of DC thermoswitches comprises:

a first DC thermoswitch to be interposed between the relay coil and the DC power supplier and interrupt the DC power from the DC power supplier to the relay coil when a temperature of the fixing roller exceeds a first threshold temperature; and a second DC thermoswitch to be interposed between the relay coil and the DC power supplier and interrupt the DC power from the DC power supplier to the relay coil when a temperature of the fixing roller exceeds a second threshold temperature different from the first threshold temperature.

8. An image forming apparatus, comprising:

a fixing roller to fix a toner on a recording medium;

a heater to heat the fixing roller;

an alternating current (AC) power source to supply an AC electric power;

a unit interposed between the heater and the AC power source, the unit including a power converting part to convert the AC electric power with a low frequency to a high frequency power suitable for induction heating of the heater, the unit configured to selectively apply the high frequency power to the heater so as to control heating of the fixing roller;

a relay comprising:

a first relay contact point disposed on a first AC power supply line between the AC power source and the unit; and a relay coil to open and close the first relay contact point; the relay selectively supplying the AC electric power from AC power source to the power control switch;

a direct current (DC) power supplier to supply a DC power to the relay coil; and a DC thermoswitch interposed on a DC power supply line between the DC power supplier and the relay coil to control the supply of the AC electric power from the AC power source to the heater and the unit according to an overheating temperature of the fixing roller, wherein the first relay contact point is situated with respect to the AC power source and the power converting part such that, when the first relay contact point is in an open position, the AC electric power from the AC power source is prevented from being supplied to the power converting part, thereby no high frequency power is applied to the heater, wherein the DC thermoswitch comprises a plurality of DC thermoswitches connected in series such that, when at least one of the plurality of DC thermoswitches is switched to an open position according to overheating of the fixing roller, the DC power from the DC power supplier is prevented from being supplied to the relay coil to stop an operation of the power converting part and not to output the converted high frequency power to the heater.

9. The image forming apparatus according to claim 8, wherein:

the DC power supplier supplies the DC power to a logic circuit of the power converting part, and the plurality of DC thermoswitches is are situated with respect to the DC power supplier, the relay coil and the power converting part such that, when at least one of the DC thermoswitches is switched to an open position according to overheating of the fixing roller, the DC power from the DC power supplier is prevented from being supplied to both the relay coil and the logic circuit of power converting part to stop an operation of the power converting part and not to output the converted high frequency power to the heater.

10. The image forming apparatus according to claim 8, wherein:

the plurality of DC thermoswitches comprises a first DC thermoswitch to interrupt the DC power from the DC power supplier to the relay coil when a temperature of the fixing roller exceeds a first threshold temperature and a second DC thermoswitch to interrupt the DC power from the DC power supplier to the relay coil when a temperature of the fixing roller exceeds a second threshold temperature different from the first threshold temperature.

11. The image forming apparatus according to claim 8, wherein:

the relay further comprises a second relay contact point which is driven by the relay coil and disposed on a second AC power supply line between the heater and the AC power source.

12. The image forming apparatus according to claim 8, wherein:

the plurality of DC thermoswitches comprises two DC thermoswitches which are mounted at different positions adjacent to the fixing roller, respectively, and the two DC thermoswitches are directly connected in series.

13. The image forming apparatus according to claim 8, wherein:

the plurality of DC thermoswitches comprises three or more DC thermoswitches which are mounted at different positions adjacent to the fixing roller, respectively.

14. The image forming apparatus according to claim 8, wherein:

the plurality of DC thermoswitches comprise:

a first DC thermoswitch to interrupt the DC power from the DC power supplier to the relay coil when a temperature of the fixing roller exceeds a first threshold temperature; and a second DC thermoswitch to interrupt the DC power from the DC power supplier to the relay coil when a temperature of the fixing roller exceeds a second threshold temperature different from the first threshold temperature.

* * * * *